US005938479A

United States Patent [19]

Paulson et al.

[11] Patent Number: 5,938,479

[45] Date of Patent: Aug. 17, 1999

[54] CONNECTOR FOR REDUCING ELECTROMAGNETIC FIELD COUPLING

[75] Inventors: Chad M. Paulson, Hector; Donald A. Ward, Danube, both of Minn.

[73] Assignee: Communications Systems, Inc., Hector, Minn.

[21] Appl. No.: 08/832,044

[22] Filed: Apr. 2, 1997

[51] Int. Cl.[6] ..... H01R 23/02

[52] U.S. Cl. ..... 439/676; 439/941

[58] Field of Search ..... 439/676, 941, 439/404, 405, 409, 417

[56] References Cited

U.S. PATENT DOCUMENTS

| | | | |
|---|---|---|---|
| 5,186,647 | 2/1993 | Denkmann et al. | 439/676 |
| 5,547,405 | 8/1996 | Pinney et al. | 439/941 |
| 5,586,914 | 12/1996 | Foster, Jr. et al. | 439/941 |
| 5,674,093 | 10/1997 | Vaden | 439/941 |

*Primary Examiner*—Paula Bradley
*Assistant Examiner*—Tho D. Ta
*Attorney, Agent, or Firm*—Westman, Champlin & Kelly, P.A.

[57] ABSTRACT

An electrical connector reduces cross talk between conductors carrying high frequency signals between input and output terminals. The connector has a lead frame with conductors that have generally parallel portions, but wherein some of the conductors have portions formed as out of the plane of the parallel portions as a hump. The humps have sections that provide spring contacts for engagement with a plug. The cross talk between specific conductors is further reduced by including capacitive coupling between selected conductors, and by positioning the conductors in desired locations relative to the conductors of other pairs of wires. The connector is provided with a load bar system for permitting easy coupling of the individual wires to input terminals.

14 Claims, 9 Drawing Sheets

CONNECTOR FOR REDUCING ELECTROMAGNETIC FIELD COUPLING

BACKGROUND OF THE INVENTION

The present invention relates to an electrical connector for carrying signals from input terminals to output contacts using conductors designed to reduce electromagnetic field coupling between the conductors. The connector also has a wire termination bar that hinges into place for ease of connection of the wires to the input terminals.

In the prior art, various connectors have been advanced for carrying relatively high frequency signals. Because the connectors are small, and the individual pairs of signal carrying wires are quite close together, there is a good bit of cross coupling or cross talk between the sets of wires for cross talk. Also, the present lead frames have spring contacts with conductors that run parallel to each other to further raise problems with cross talk. The ability to install the lead frames and wires easily into a housing is also desired. One solution has been to twist the conductors in the coupler housing to cancel the fields. The twisting causes problems in manufacturing and assembly.

SUMMARY OF THE INVENTION

The present invention provides an electrical connector that has metallic lead frames made from flat plates with multiple spring contacts for receiving a plug that also includes metallic contacts that engage the spring contacts of the connector. The wires leading to the lead frames of the connector are connected through insulation displacement contacts (IDCs) forming input terminals at an opposite end from the spring contacts. Metal conductors extend between the input terminals and the spring contacts, which form output terminals.

The IDCs are connected to wires using a load bar that not only makes connection simple, but also permits the displacing of the IDCs that they are not all on the same plane. The wires leading to the load bar can be twisted right up to the point of termination, which also tends to reduce the cross talk.

The metallic lead frames are arranged so that the conductors between the input terminals and the spring contacts are not all parallel to reduce the field coupling between individual wires and pairs of wires. The conductors for the wires of selected pairs also are spaced substantially in two perpendicular directions.

The lead frame also can be formed with a pair of capacitor plates, one connected to a wire in each of a separate pair of wires, to create a capacitive coupling to balance the cross talk between specific conductors.

Within the small space allowed for this type of a connector, a substantial reduction in cross talk is achieved. A feature of the assembly is that the housing is designed to receive an electrically enhancing gel that is now used in many electrical connectors for improving the reliability and life of the connectors.

A further feature is that the load bar for terminating the wires is hinged into the connector housing to align the wires with the insulation displacing connectors, and then upon pivoting the load bar into a position, the wires are pierced by the insulation for making the connection.

DETAILED DESCRIPTION OF THE PREFERRED EMBODIMENTS

Figure 1:
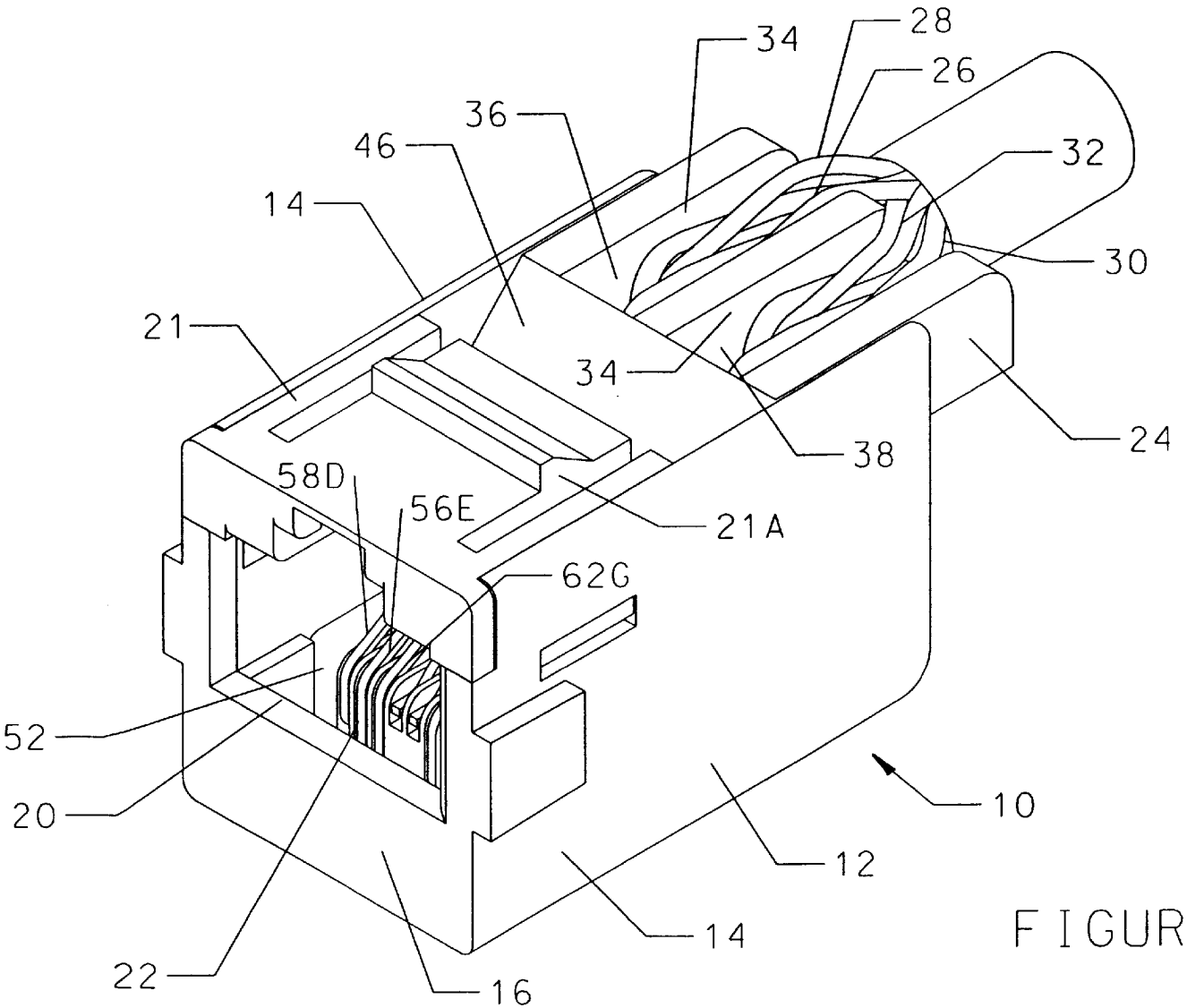
FIG. 1 is a perspective view of a connector made according to the present invention.
Figure 9:
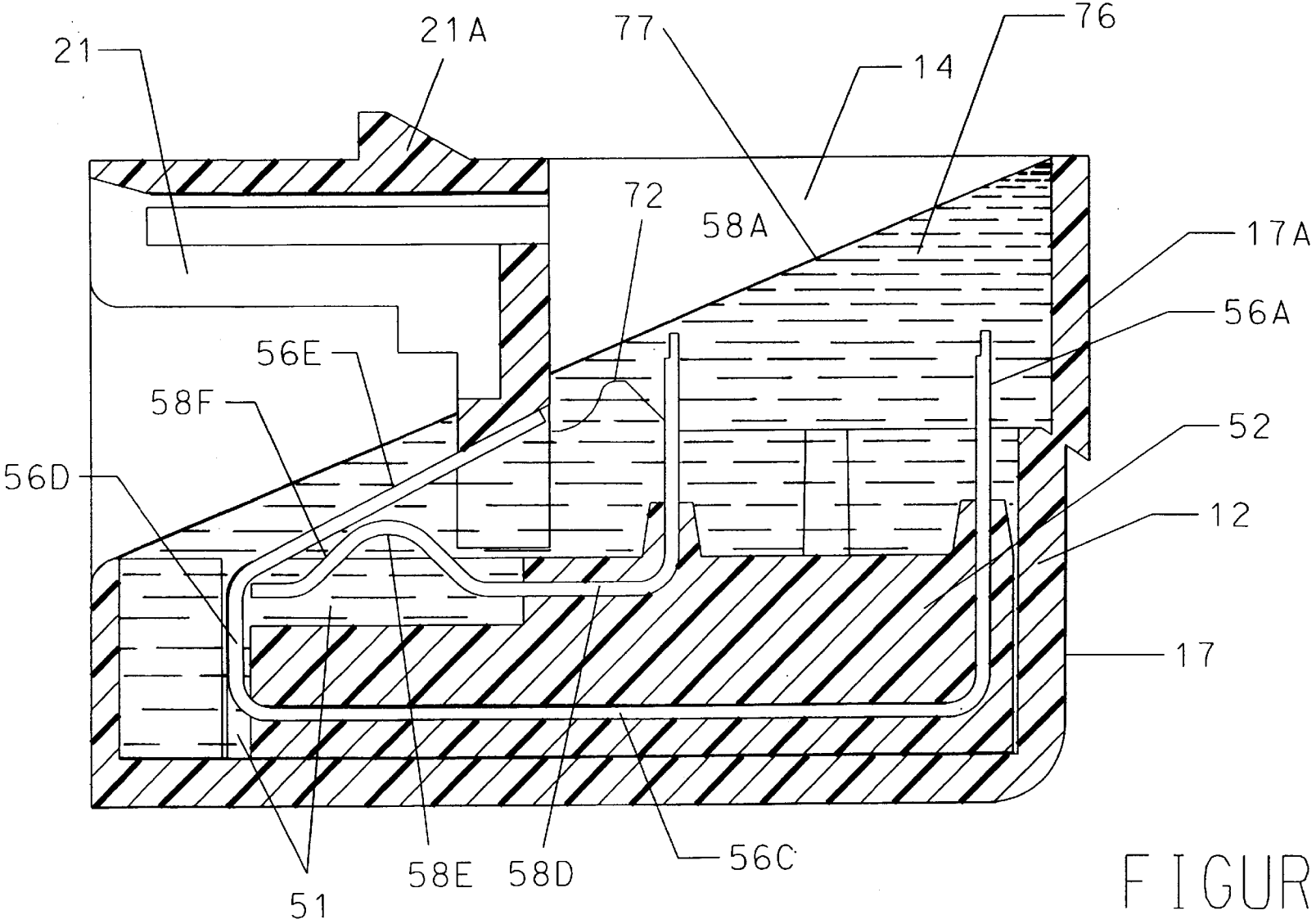
FIG. 9 is a longitudinal sectional view of the connector showing a filling of a protective gel prior to installing a load bar.

In FIG. 1, a high frequency communication connector 10 is illustrated in perspective view, and it includes an outer housing 12 having upright side walls 14 and a front end wall 16 as well as a rear wall 17 (see FIG. 9). The front wall 16 has a modular plug opening 20 that will receive a modular plug having wire contacts that will engage spring contacts shown generally at 22 through the opening 20. The spring contacts 22 in the connector 10 will be individually numbered subsequently.

Figure 4:
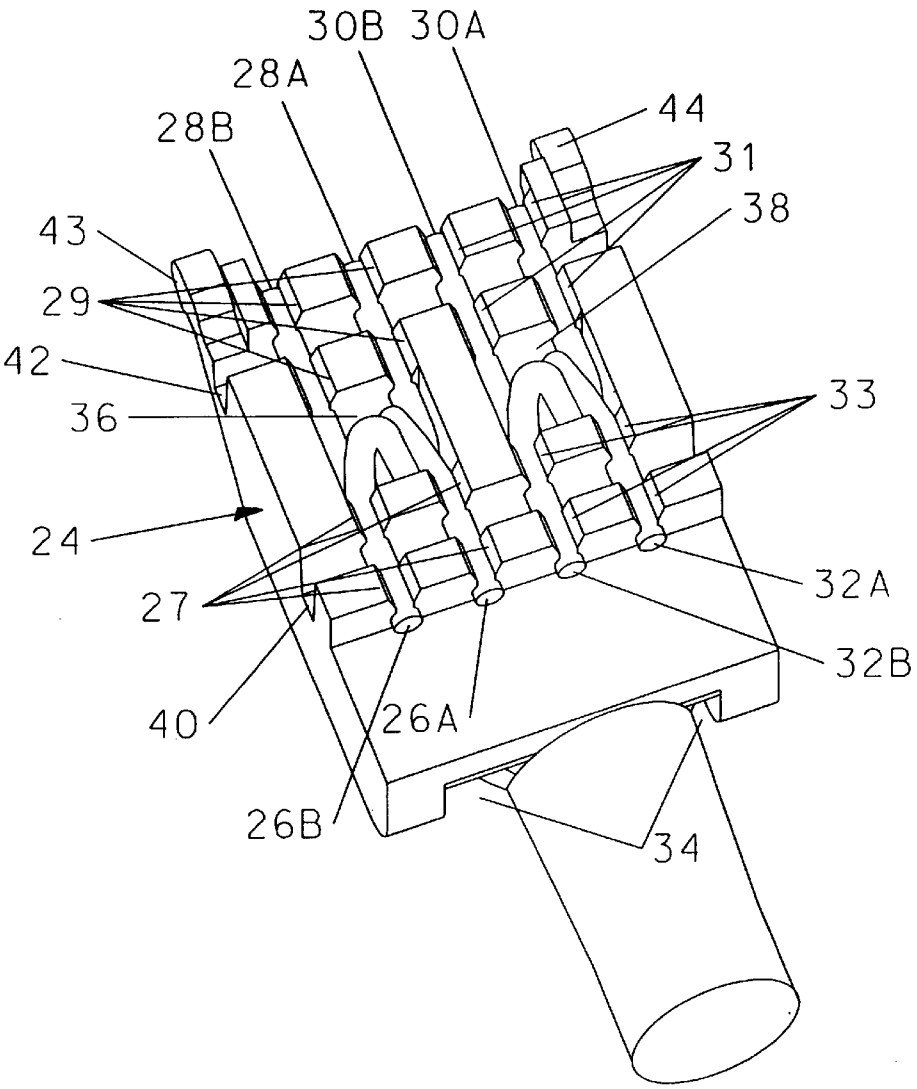
FIG. 4 is a perspective bottom view of a load bar that is utilized with the housing of the present invention for terminating twisted pairs of wires as illustrated.

In the form shown, a latch block 21 forms a top wall at the plug end of the housing. The latch block has a flexible or spring latch dog 21A secured to the front edge of the block 21 with the rear portion deflectable in a conventional manner and is used to snap the connector into place on a plate or frame. A load bar 24 is mounted at an opposite end of the housing 12 from the front wall 16. The load bar carries four twisted pairs of wires, which are represented generally at 26, 28, 30 and 32. The wires are conventional communication wires, formed into twisted pairs and used for high frequency digital communication signals. The termination load bar 24 has channel shaped recesses 34 on the upper side thereof as shown, each holding two of the twisted pairs. The load bar 24 has openings 36 and 38 that permit the pairs of wires to be carried down to the bottom side of the load bar 24. FIG. 4 shows the bottom side of the load bar with the twisted pairs of wires that are represented schematically where they enter the respective channels 34, and pass through the openings 36 and 38. Each pair of wires is separated so that the individual wires of each pair are bent in the same direction, one pair forwardly and one pair rearwardly.

As shown, twisted pair 26 has wires 26A and 26B that extend through opening 36 and then extend toward the outer end of the load bar 24 and are placed in provided parallel channel sections 27. The twisted pair 28, which also is extended through opening 36, has wires 28A and 28B that extend in opposite directions toward the inner end of the load bar, and lie in side by side channel sections 29. The two pairs of wires passing through the opening 38 are likewise separated so the individual wires 32A and 32B extend toward the outer end of the load bar and lie in side by side channel sections 33, and the wires 30A and 30B extend toward the inner end of the load bar and lie in side by side channel sections 31. It can be seen that the wires 26A, 26B, 28A, 28B, 30A, 30B, 32A and 32B extend across provided transverse recess channels 40 and 42, respectively that extend transversely to and split each of the channels 27, 29, 31 and 33 into two sections. The wires 26, 28, 30 and 32 span the channels 40 and 42 when they are laid in their respective channel sections 27, 29, 31 and 33. The wires are spaced above the bottoms of channels 40 and 42 and supported by the channel sections.

The load bar 20 has pivot hub ends 43 and 44 at the inner ends of the side walls. The load bar 24 fits between the side walls 14 of the housing 12. The load bar 24 has a beveled forward or top wall 46 at its pivot end, as shown, for permitting the load bar to be moved into position on the housing, as will be explained.

A lead frame assembly 50 is made up of a dielectric material (plastic) lead frame block 52 and a plurality of individual conductors or conductor bars shown generally at 54. The conductors 54 are shown separated from the lead frame block in FIG. 5, and also in FIG. 6. The conductors are insulated from each other and molded into the block 52 and have portions that fit into slots shown generally at 51 in FIGS. 2 and 9. The slots are formed to the particular configuration needed for the conductors.

Typically, the conductors include an insulation displacement contact (IDC) for each of the individual wires of the twisted pairs carried by the load bar. When the load bar 24 is moved into the housing 12, the portions of the wires that span the respective channels 40 and 42 are electrically connected with the underlying aligned IDC. The upper ends of the IDCs extend into the channels 40 and 42, respectively and have slots 70 that are defined by edges that slice into the insulation on the wires and electrically connect to the internal wire.

The wires 26A and 26B are moved into insulation displacement contacts 56A and 56B, respectively. The IDCs 58A and 58B connect to the wires 28A and 28B. The IDCs 60A and 60B couple to the wires 30A and 30B and the IDCs 62A and 62B couple to the wires 32A and 32B.

Each of the IDCs is made of an electrically conductive metal, and is suitably plated, and is connected to a conductor that leads to a spring contact, forming one of the spring contacts 22 for a plug.

The construction and arrangement of the conductors and the spring contacts is such that it will reduce the cross talk between the respective conductors during use by using techniques to minimize the effects of fields generated by currents in the wires.

The IDC 62A has a conductor bar 62C that has a length and is formed to pass around toward the front of the block 52. It has an upright leg and then is formed into an upwardly inclined spring contact 62D. The spring contact 62D is straight along a length forming a contacting portion for engagement with a plug.

The IDC 62B is connected to a conductor bar 62E that has a forwardly extending length, and has a cross conductor section 62F that offsets laterally and then is formed into spring contact 62G which is parallel to and aligned with contact 62D. This particular IDC 62B is also connected to a capacitor plate 62H (see FIG. 6) that is joined to conductor bar 62E with a conductor bar 62J. The capacitor plate 62H extends substantially parallel to the axis of the elongated, forwardly extending conductor bar 62E. Plate 62H forms one plate of a capacitor to balance cross talk between selected conductors.

The IDC 56A, which is on the same transverse plane as the IDCs 62A and 62B, has a forwardly extending conductor bar 56C, formed to have a forward uprightly extending conductor bar portion 56D and a spring contact 56E that is on an inclined plane and is parallel to the contact 62D.

The IDC 60A, that is part of the group of IDCs toward the front of the mounting block 50, has a forwardly extending conductor bar 60C that is formed into a uprightly curved raised or hump portion 60D that has an inclined forward section 60E, substantially parallel to and sufficiently aligned with portions of the other spring contacts so plug contact wires engage both spring contacts. This section 60E thus forms a spring contact, which is thus not parallel to the straight length of conductor bar 60C or to conductor bar 62C. The hump portion 60D further aids in reducing cross talk. The field that is generated by currents in the hump portion of 60D is not aligned with the fields of the other long, straight conductor bars that extend from IDCs or input terminals to the spring contacts or output terminals.

The IDC 60B has a forwardly extending conductor bar 60F, which also has a curved or raised hump portion 60G that has a forward section 60H that aligns with the section 60E and forms a spring contact. The conductor bars 60C and 60F will provide a resilient spring pressure on the hump sections that act as spring contacts. The ends of the conductor bars can extend forwardly from the hump portions, as shown, beyond the inclined sections 60E and 60H, and these sections are above the slots in the support block receiving the conductor bar sections 60E and 60H for spring contact travel.

The IDC 56B has a forwardly extending conductor bar 56F with an upright end portion 56G and an inclined spring contact portion 56H, parallel to and adjacent spring contact 56E.

Figure 5:
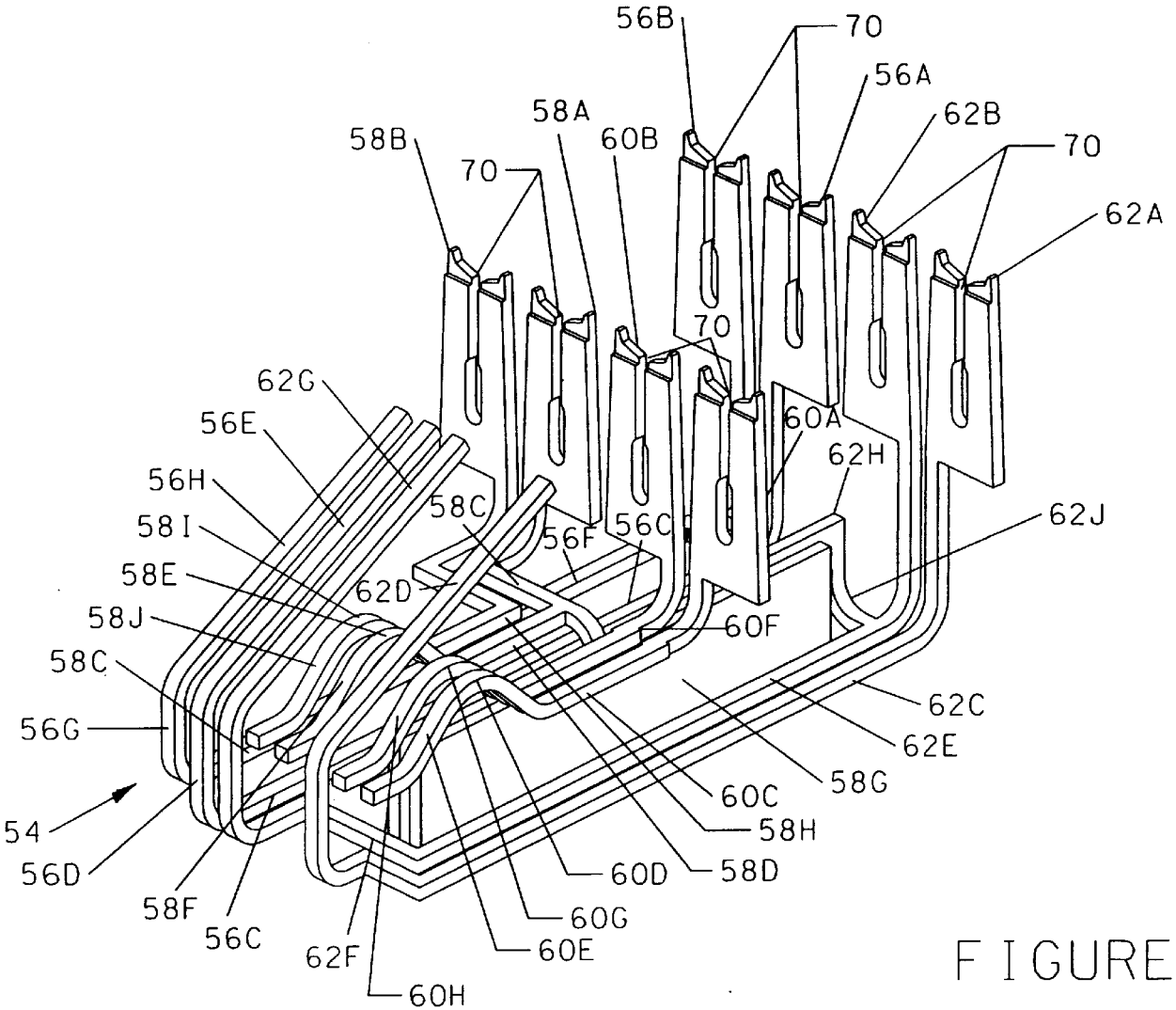
FIG. 5 is a perspective view of a lead frame used with the connector of the present invention with the support block removed.
Figure 6:
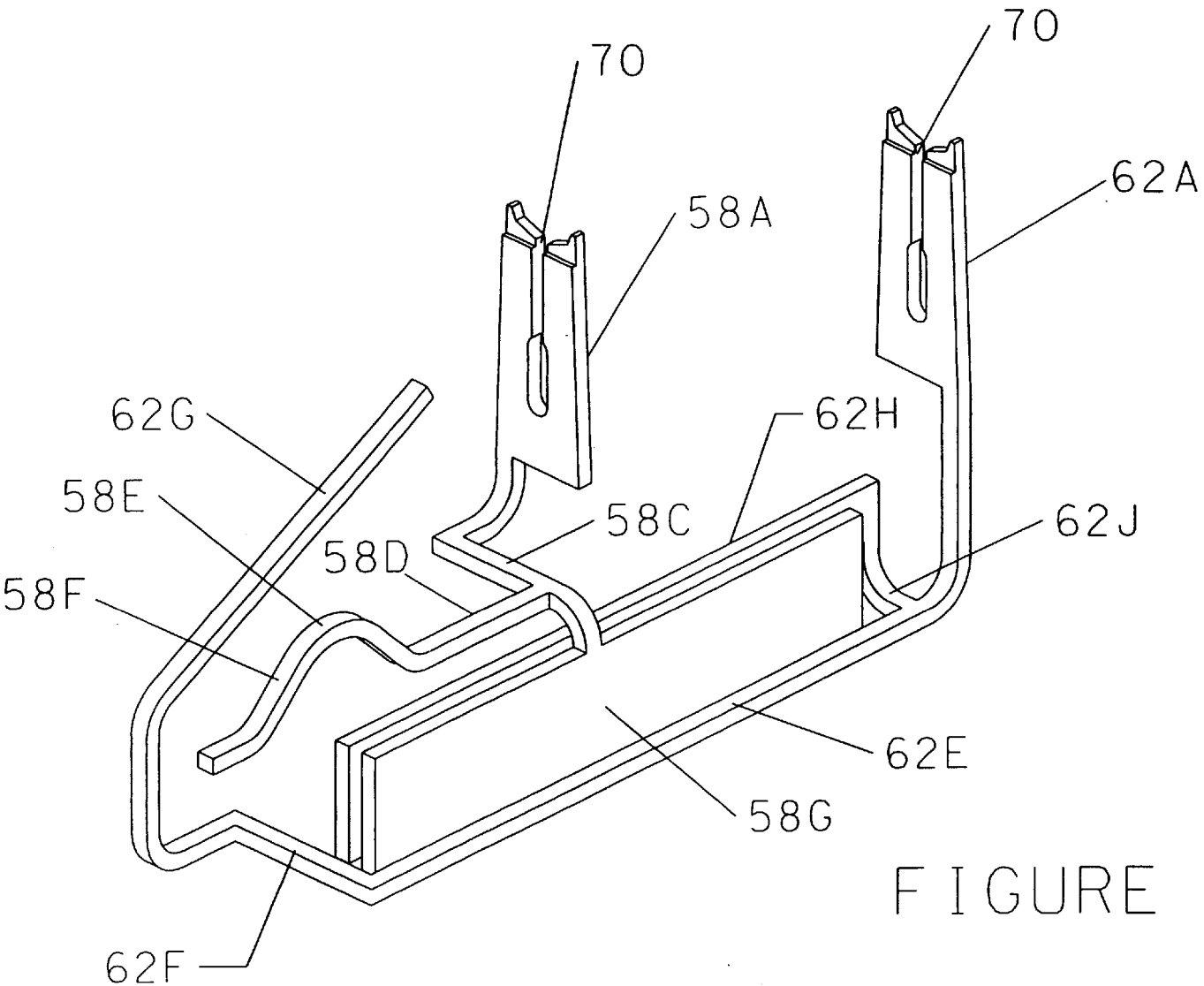
FIG. 6 is a perspective view of two of the insulation displacement contacts and associated spring contacts, which also are formed to include capacitor plates for capacitively coupling the connectors with a supporting dielectric block broken away.

The IDC 58A is made not only to connect to a spring contact for a plug that is inserted in the connector 10, but also connect to a second capacitor plate for capacitive coupling. In this form of the invention, as can be seen in FIGS. 5 and 6, the IDC 58A is connected to a conductor bar 58C that extends forwardly for clearance and then laterally to be spaced from and above the conductor 56C. The conductor bar 58C has then a forwardly extending conductor portion 58D integrally attached thereto, which has a hump portion 58E forming a forward spring contact section 58F. The contact section 58F is between, and generally laterally aligning with portions of the spring contacts 62D and 62G.

The conductor bar 58C further extends laterally across and above the capacitor plate 62H, and a depending capacitor plate 58G is mounted thereon and extends parallel to and substantially coextensive with the capacitor plate 62H to provide a capacitive coupling between two wires of different pairs of wires for reducing noise.

The IDC 58B has a conductor bar 58H which includes a laterally offset section to bring a forwardly extending conductor bar portion into the center of the connector. The conductor bar 58H then extends forwardly and has a raised hump portion 58I with an inclined spring contact section 58J aligning laterally sufficiently for use with the hump contact section 58F. It can be seen that this spring contact section 58J of the conductor bar 58H is aligned with and adjacent the spring contact portion 58F.

Figure 2:
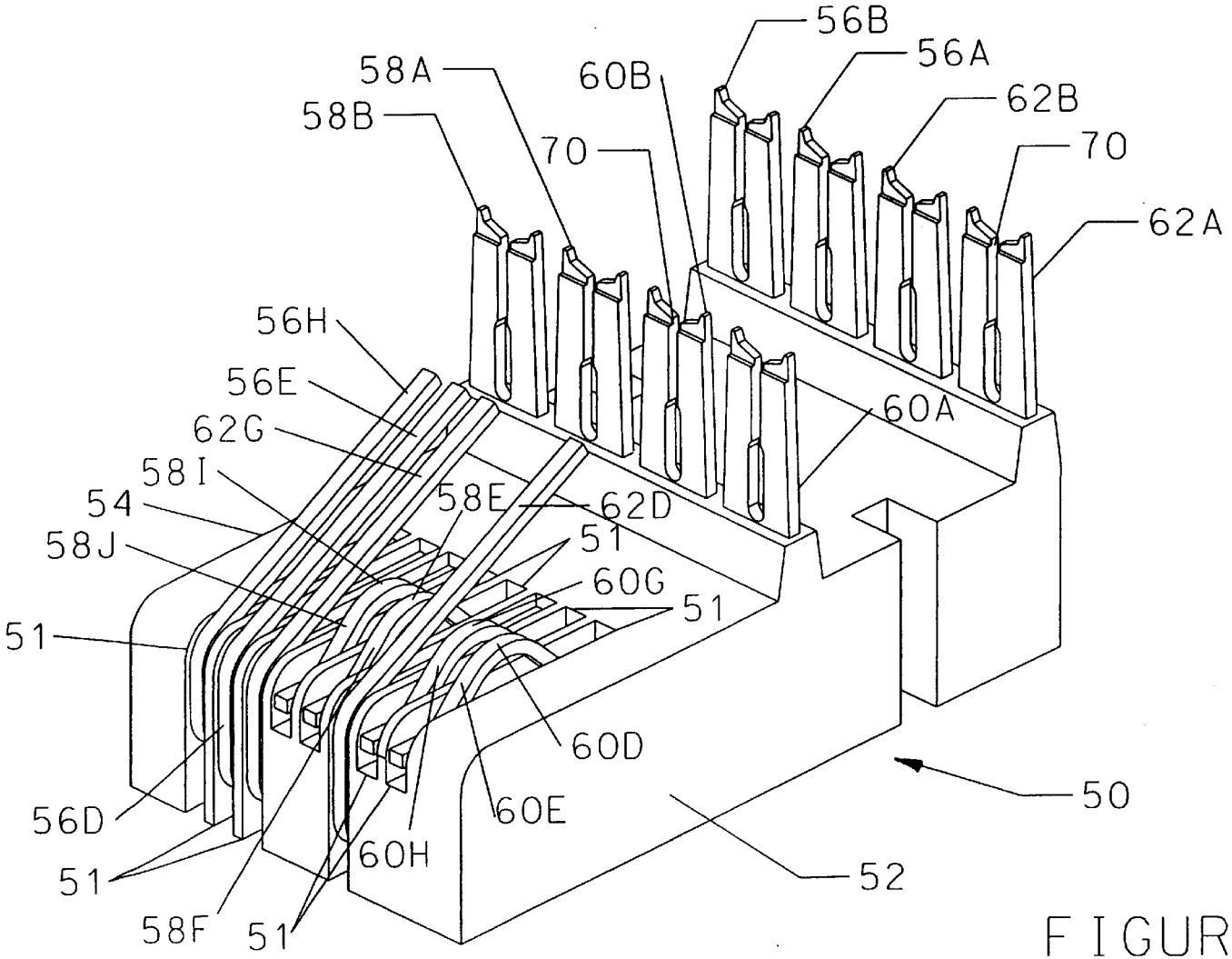
FIG. 2 is a perspective view of a lead frame and support block inside an outer housing.
Figure 3:
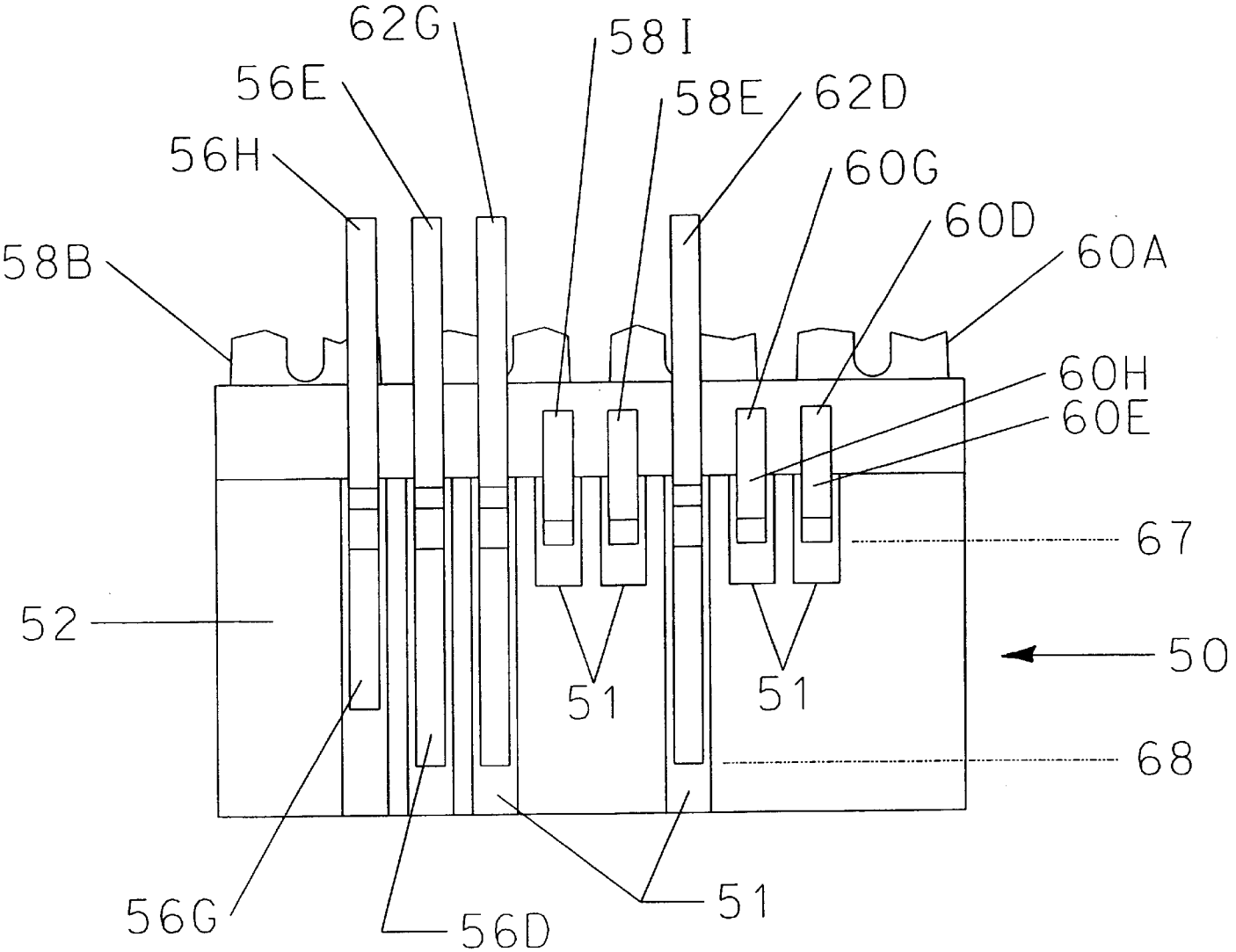
FIG. 3 is a fragmentary front view of the lead frame and support block shown in FIG. 2.

As shown in FIG. 3, the plane 67 of conductors 62E, 60F, 58E and 56G is offset vertically from the plane 68 of conductors 58C, 56C, 62C and 60C, as shown in FIGS. 2 and 9 to further separate the fields around the conductors. The direction of offset of the planes 67 and 68 is in a direction perpendicular to these planes.

The block 52, including the conductors, IDCs and spring contacts is mounted in the housing 12 between the walls 14 with the contacts aligned axially with the opening 20 at the front end of connector housing. The inclined spring contacts have their free end guided in a comb type slotted member 75 (see FIG. 9) depending from block 21 in conventional manner.

Figure 7:
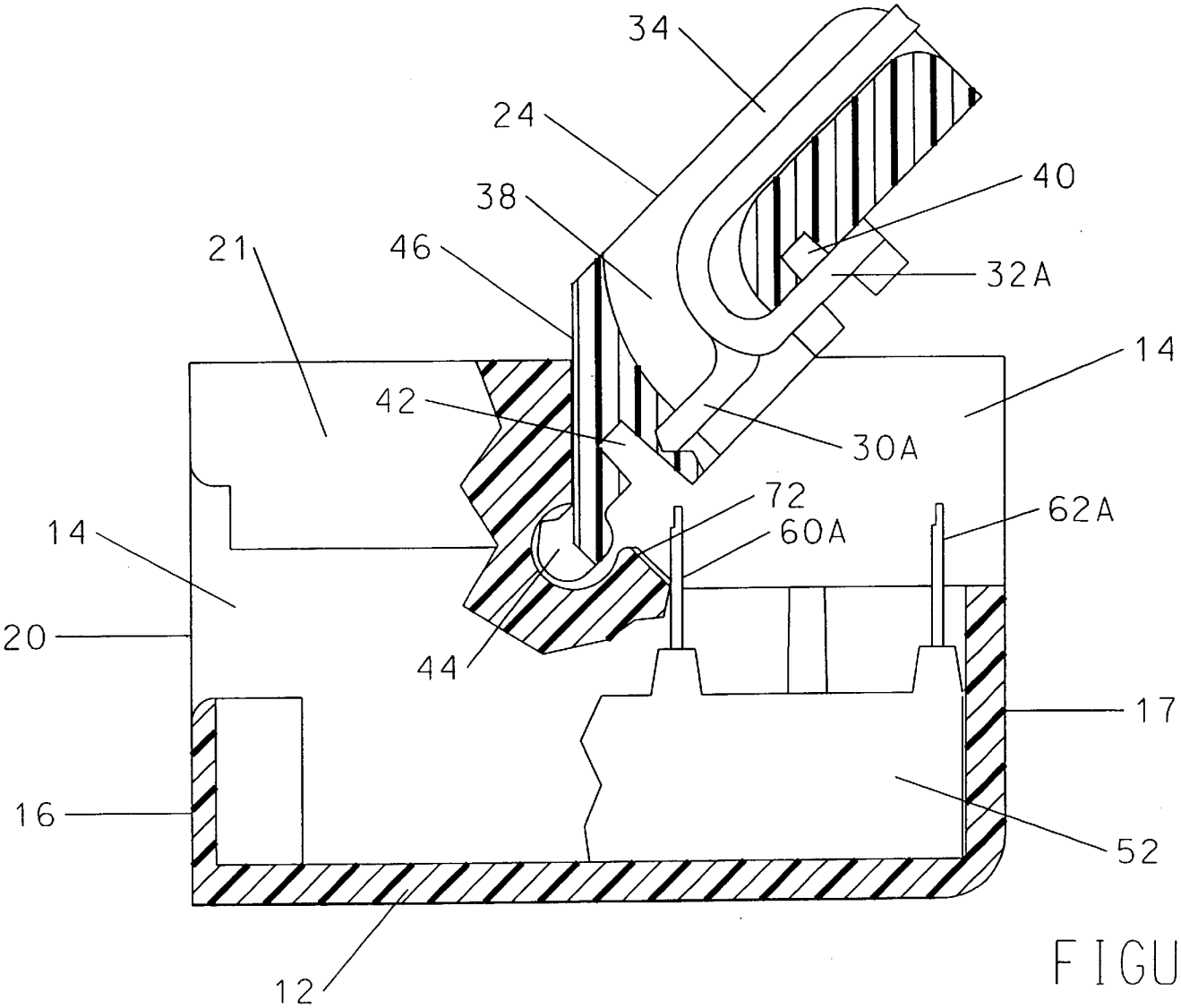
FIG. 7 is a schematic cross sectional view illustrating a load bar being moved into a connector housing.

When the load frame is in place and the wires are to be installed, the wires are connected into the load bar as shown in FIG. 4. The wires are bent down into the channels 27, 29, 31 and 33 so that they will not be disturbed. The hub ends 43 and 44 that form the pivots for the load frame are slipped into provided receptacles formed in the side walls 14, with clearances for block 21 that is mounted between the walls 14, 14. Because of the beveled forward wall 46 on the load bar, the load bar and the attached wires can be tilted upwardly, as illustrated in FIG. 7 with the forward ends of the load bar between side walls 14. At the tilt angle of the load frame the pivot hub ends will slip into the receptacles.

Figure 8:
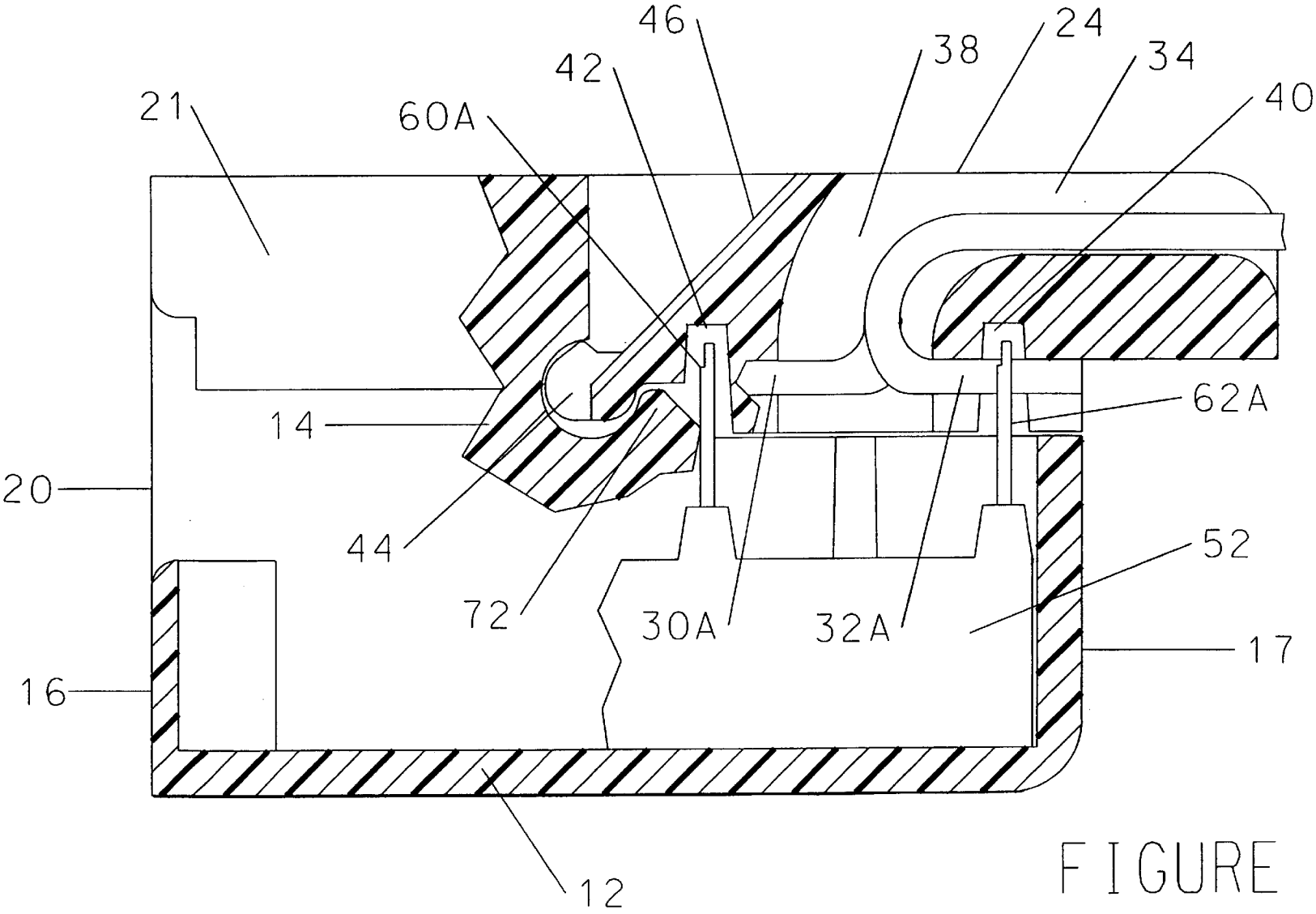
FIG. 8 is a sectional view similar to FIG. 7 illustrating a load bar in a usable position.

The load frame and the wires are above the IDCs, which have the slit ends that project upwardly. The ends of the IDCs align with the channels 40 and 42 respectively. The individual wires held by the load bar extend across the channels 40 or 42. Then, when the load bar 24 is pivoted down into its final position, as shown in FIG. 8, the slits or slots 70 in the ends of the IDCs will receive the respective wires and the edges of the slits or slots slice through the insulation to make a good electrical connection as the load bar 24 is pivoted to its final position. The load bar can be latched in place, or can be held in place in any suitable manner.

The housing 12 forms an enclosure that can be filled with a suitable protective gel and when the unit is in place, the gel will cover the spring contacts and the IDCs to provide the benefits obtainable. The showing of FIG. 9 shows the housing 12 with the lead frame 50 in place, but also before a break away wall 17A has been removed to permit the load bar 24 to be installed. The protective gel 76 is filled to line 77, and the wall can be broken away. The load bar is pivoted down and forces the gel to squeeze out into the openings 75 of the load bar and cover the wires.

Note also in FIG. 9 that the block 52 is broken away at two levels so the conductors for IDCs 56A and 56B are both shown, even though they are laterally offset from each other.

The pivot connection between the housing and the load bar can be made in any desired manner, but the form shown is one which can be easily molded in place without having separate pins. The load bar pivot hubs 43 and 44 have a flat upper side, as can be seen in FIG. 7, so that they will slip through the receptacles formed for the hubs when the load bar is tilted up and when in their final horizontal position the hubs will rest against a lug 72 to prevent pulling the hubs 43 and 44 out of the provided pivot receptacles in horizontal direction.

The vertical offset of the conductors, the hump contact configuration, the lateral spacing apart of the conductors of the same pair with conductors of another pair between them, and the capacitor plates all help in reducing cross talk. The conductors are specifically designed to carry high frequency signals.

Although the present invention has been described with reference to preferred embodiments, workers skilled in the art will recognize that changes may be made in form and detail without departing from the spirit and scope of the invention.

What is claimed is:

1. A connector for a multiple wire arrangement utilizing a plurality of twisted pair of wires, said connector being adapted for connection to a plug at a first end, the connector comprising electrical conductors extending along the connector from a second end wherein the wires attach to the conductors to the first end, said conductors having first conductor portions that are parallel to first conductor portions of other conductors and second spring contact portions for connection to the plug at the first end, the spring contact portions of selected conductors for the respective wires each being formed by offset sections formed between two straight lengths of the selected conductors that are parallel to a plane formed by the first conductor portions of the other conductors.

2. The connector of claim 1, wherein the offset sections comprise a raised hump having an inclined section that is formed to mate with spring contacts on the plug connected to the connector.

3. The connector of claim 2, wherein each conductor having an offset section is positioned laterally between the conductors connected to one other pair of wires.

4. The connector of claim 2, wherein each selected conductor is offset from the parallel first portions of the conductors connected to the other pair of wires in direction perpendicular to a plane defined by the parallel first portions.

5. The connector of claim 4, wherein there are four pairs of wires, two pairs of wires being connected to selected conductors having offset sections, the conductors having offset sections for each pair of wires being spaced but adjacent to each other, and at least one of the other conductor having a straight spring contact portion bent at an angle from the first conductor portion of the at least one of the other conductors positioned between the selected conductors for a first pair of wires and the selected conductors for a second pair of wires.

6. The connector of claim 5, wherein the at least one other conductor is connected to one wire of a selected pair of wires, the other wire of the selected pair being connected to a conductor positioned spaced from the at least one other conductor by two of the selected conductors.

7. An electrical connector including a plurality of input terminals, a plurality of output terminals, an interconnection apparatus for electrically interconnecting the input and output terminals, the interconnection apparatus comprising at least two pairs of conductors that are spaced apart from each other and mounted relative to a dielectric surface, at least portions of said conductors being parallel to each other between the input terminals and spring contact portions for connection to a plug, and conductors of at least one of the pairs of conductors each having a non parallel portion between straight lengths of the conductors of the at least one pair in the spring contact portions thereof that forms the conductors of the at least one pair out of parallel with a plane defined by portions of the conductors of at least one other pair of conductors between the input terminals and spring contact portions thereof, the straight lengths of the spring contact portions being parallel to the plane, whereby cross talk of electrical signals between the conductors in the electrical connector is reduced.

8. The electrical connector of claim 7, wherein said input terminals comprise insulation displacement contacts aligned along a plane, and a wire receiving slit in each of the insulation displacement contacts, one of the insulation displacement contacts for a first pair of wires being positioned generally parallel to and spaced from a plane defined by the insulation displacement contacts for a second pair of wires.

9. The electrical connector of claim 7, wherein the connector includes a housing and wherein the insulation displacement contacts are mounted in a support block in the housing and project upwardly from the support block, a wire load bar supporting the individual wires of each pair of wires in alignment with respective insulation displacement contacts, a pivot connection between the load bar and the housing for pivotally mounting the load bar with the wires spaced from the insulation displacement contacts in a first position, said load bar being moved to a second position wherein wire receiving slots in the insulation displacement contacts engage respective wires held in the load bar and form an electrical connection to the wires.

10. The electrical connector of claim 7, wherein said connector has an outer housing that is formed with upright walls to form an enclosure suitable for filling with a gel material surrounding the conductors.

11. The electrical connector of claim 7, wherein the one pair of conductors having non parallel portions is positioned between the individual conductors of another pair of conductors.

12. The electrical connector of claim 7, wherein the conductors connected to a first pair of wires are spaced from each other in a first plane, and the conductors of a second pair of wires are spaced from each other in a second plane, the second plane being spaced from the first plane in a direction perpendicular to the first plane.

13. The electrical connector of claim 7, wherein there is a first capacitor plate coupled to the conductor of said first pair of conductors connected to a first pair of signal carrying wires and a second capacitor plate coupled to the conductor of said second pair of conductors connected to a second different pair of signal carrying wires, said capacitor plates having plate planes positioned 90° relative to the plane defined by the portions of the at least one other pair of conductors and being adjacent to each other to form a capacitive coupling between wires carrying different signals to reduce cross talk in the electrical connector.

14. The electrical connector of claim 13, wherein the second capacitive plate is connected to the conductor by a coupling conductor that is spaced from but extends transversely across the first capacitor plate.

* * * * *